US009229361B2

(12) United States Patent
Matsumoto et al.

(10) Patent No.: US 9,229,361 B2
(45) Date of Patent: Jan. 5, 2016

(54) DEVELOPER CONVEYANCE DEVICE, IMAGE FORMING APPARATUS, AND DEVELOPER CONVEYANCE METHOD

(71) Applicants: Junichi Matsumoto, Kanagawa (JP); Kiyonori Tsuda, Kanagawa (JP); Nobuo Takami, Kanagawa (JP); Yutaka Takahashi, Kanagawa (JP); Kentaro Mikuniya, Tokyo (JP); Keinosuke Kondoh, Kanagawa (JP); Tetsuya Muto, Kanagawa (JP)

(72) Inventors: Junichi Matsumoto, Kanagawa (JP); Kiyonori Tsuda, Kanagawa (JP); Nobuo Takami, Kanagawa (JP); Yutaka Takahashi, Kanagawa (JP); Kentaro Mikuniya, Tokyo (JP); Keinosuke Kondoh, Kanagawa (JP); Tetsuya Muto, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 14/329,292

(22) Filed: Jul. 11, 2014

(65) Prior Publication Data

US 2015/0055966 A1 Feb. 26, 2015

(30) Foreign Application Priority Data

Aug. 22, 2013 (JP) ..... 2013-172284

(51) Int. Cl.
*G03G 15/08* (2006.01)
*G03G 15/00* (2006.01)

(52) U.S. Cl.
CPC ..... *G03G 15/0824* (2013.01); *G03G 15/0865* (2013.01); *G03G 15/0831* (2013.01); *G03G 15/553* (2013.01); *G03G 2215/0888* (2013.01); *G03G 2221/183* (2013.01)

(58) Field of Classification Search
CPC ..... G03G 15/98
USPC ..... 399/27
See application file for complete search history.

(56) References Cited

U.S. PATENT DOCUMENTS

| | | | | |
|---|---|---|---|---|
| 5,521,690 | A * | 5/1996 | Taffler et al. | 399/93 |
| 5,592,267 | A * | 1/1997 | Misago et al. | 399/62 |
| 5,987,298 | A * | 11/1999 | Muramatsu et al. | 399/359 |
| 6,608,983 | B2 * | 8/2003 | Terazawa et al. | 399/258 |
| 6,826,381 | B2 * | 11/2004 | Muramatsu et al. | 399/260 |
| 7,127,198 | B2 * | 10/2006 | Muramatsu et al. | 399/258 |
| 2003/0142999 | A1 * | 7/2003 | Fujii et al. | 399/258 |
| 2004/0105704 | A1 * | 6/2004 | Yamauchi et al. | 399/258 |
| 2004/0247344 | A1 * | 12/2004 | Fujii et al. | 399/258 |
| 2005/0013634 | A1 * | 1/2005 | Fujii et al. | 399/258 |

(Continued)

FOREIGN PATENT DOCUMENTS

| | | |
|---|---|---|
| AP | 2009-069659 | 4/2009 |
| JP | 2002-284345 | 10/2002 |

(Continued)

*Primary Examiner* — Clayton E Laballe
*Assistant Examiner* — Kevin Butler
(74) *Attorney, Agent, or Firm* — Harness, Dickey & Pierce, P.L.C.

(57) ABSTRACT

An image forming apparatus includes a developing device; a developer conveyance device including a developer container, a developer reservoir to receive developer discharged from the developer container, and a positive-displacement pump to discharge, from the developer reservoir, developer supplied to the developing device by alternately generating positive pressure and negative pressure due to volume changes; and a controller to control driving of the positive-displacement pump. When the controller recognizes a developer end state of the developer container, the controller lowers a developer conveyance capability of the positive-displacement pump from a setting used before the developer end state is recognized.

9 Claims, 6 Drawing Sheets

(56) References Cited

U.S. PATENT DOCUMENTS

| | | | | |
|---|---|---|---|---|
| 2005/0041998 | A1* | 2/2005 | Fujii et al. | 399/258 |
| 2005/0201780 | A1* | 9/2005 | Fujii et al. | 399/258 |
| 2006/0088352 | A1* | 4/2006 | Isokawa et al. | 399/359 |
| 2007/0166079 | A1* | 7/2007 | Ichikawa et al. | 399/254 |
| 2008/0175628 | A1* | 7/2008 | Kita et al. | 399/262 |
| 2009/0016777 | A1* | 1/2009 | Miyamoto et al. | 399/238 |
| 2009/0074432 | A1* | 3/2009 | Kita et al. | 399/30 |
| 2009/0324298 | A1 | 12/2009 | Katsuyama et al. | |
| 2010/0290815 | A1 | 11/2010 | Ichikawa et al. | |
| 2011/0182610 | A1* | 7/2011 | Ohmura et al. | 399/94 |
| 2012/0051792 | A1 | 3/2012 | Matsumoto et al. | |
| 2013/0266345 | A1* | 10/2013 | Matsumoto et al. | 399/258 |
| 2013/0272743 | A1* | 10/2013 | Kawahara | 399/94 |
| 2013/0322927 | A1 | 12/2013 | Matsumoto et al. | |
| 2013/0330105 | A1 | 12/2013 | Komatsu et al. | |
| 2014/0133889 | A1* | 5/2014 | Matsumoto et al. | 399/258 |

FOREIGN PATENT DOCUMENTS

| | | |
|---|---|---|
| JP | 2005-062648 | 3/2005 |
| JP | 2010-078730 | 4/2010 |
| JP | 2013-047714 | 3/2013 |

* cited by examiner

DEVELOPER CONVEYANCE DEVICE, IMAGE FORMING APPARATUS, AND DEVELOPER CONVEYANCE METHOD

CROSS-REFERENCE TO RELATED APPLICATIONS

This patent application is based on and claims priority pursuant to 35 U.S.C. §119(a) to Japanese Patent Application No. 2013-172284, filed on Aug. 22, 2013, in the Japan Patent Office, the entire disclosure of which is hereby incorporated by reference herein.

BACKGROUND

1. Technical Field

Embodiments of the present invention generally relate to a developer conveyance device; an image forming apparatus, such as, a copier, a printer, a facsimile machine, a plotter, or a multifunction peripheral (MFP) including at least two of copying, printing, facsimile transmission, plotting, and scanning capabilities; and a developer conveyance method.

2. Description of the Related Art

In image forming apparatuses employing a developing device, typically an exposure device forms an electrostatic latent image on an image bearer such as a photoreceptor according to image data, and the developing device develops the latent image into a toner image. The toner image is then transferred onto a recording medium either directly or via an intermediate transfer member and fixed thereon by a fixing device.

As the density of toner therein decreases, the developing device is replenished with toner, thereby keeping the density of toner constant.

Toner is transported from a toner container (i.e., a developer container) such as a toner supply tank through a conveyance channel connected to the developing device.

One of methods to transport toner is airflow conveyance employing a positive-displacement pump, which uses pressure changes caused by changes in volume in the conveyance channel.

Positive-displacement pumps generate pressure by repeatedly varying the volume of inner space, use the pressure to bring in air or powder from outside on the upstream side, and give discharge energy thereto, thereby discharging the air or powder to the downstream side. Examples of positive-displacement pumps include diaphragm pumps, piston pumps, and bellows pumps.

SUMMARY

An embodiment of the present invention provides an image forming apparatus that includes a developing device, a developer conveyance device, and a controller. The developer conveyance device includes a developer container; a developer reservoir to receive developer discharged from the developer container; and a positive-displacement pump to discharge, from the developer reservoir, developer supplied to the developing device by alternately generating positive pressure and negative pressure due to volume changes. The controller controls driving of the positive-displacement pump. When the controller recognizes a developer end state of the developer container, the controller lowers a developer conveyance capability of the positive-displacement pump from a setting used before the developer end state.

Another embodiment provides the above-described developer conveyance device.

Yet another embodiment provides a developer conveyance method that includes temporarily storing developer discharged from a developer container; discharging, with a positive-displacement pump, the developer temporarily stored by alternately generating positive pressure and negative pressure due to volume changes; judging whether or not the developer container is in a developer end state; and lowering a developer conveyance capability of the positive-displacement pump when the developer container is judged to be in the developer end state.

BRIEF DESCRIPTION OF THE SEVERAL VIEWS OF THE DRAWINGS

A more complete appreciation of the disclosure and many of the attendant advantages thereof will be readily obtained as the same becomes better understood by reference to the following detailed description when considered in connection with the accompanying drawings, wherein.

DETAILED DESCRIPTION

Figure 1:
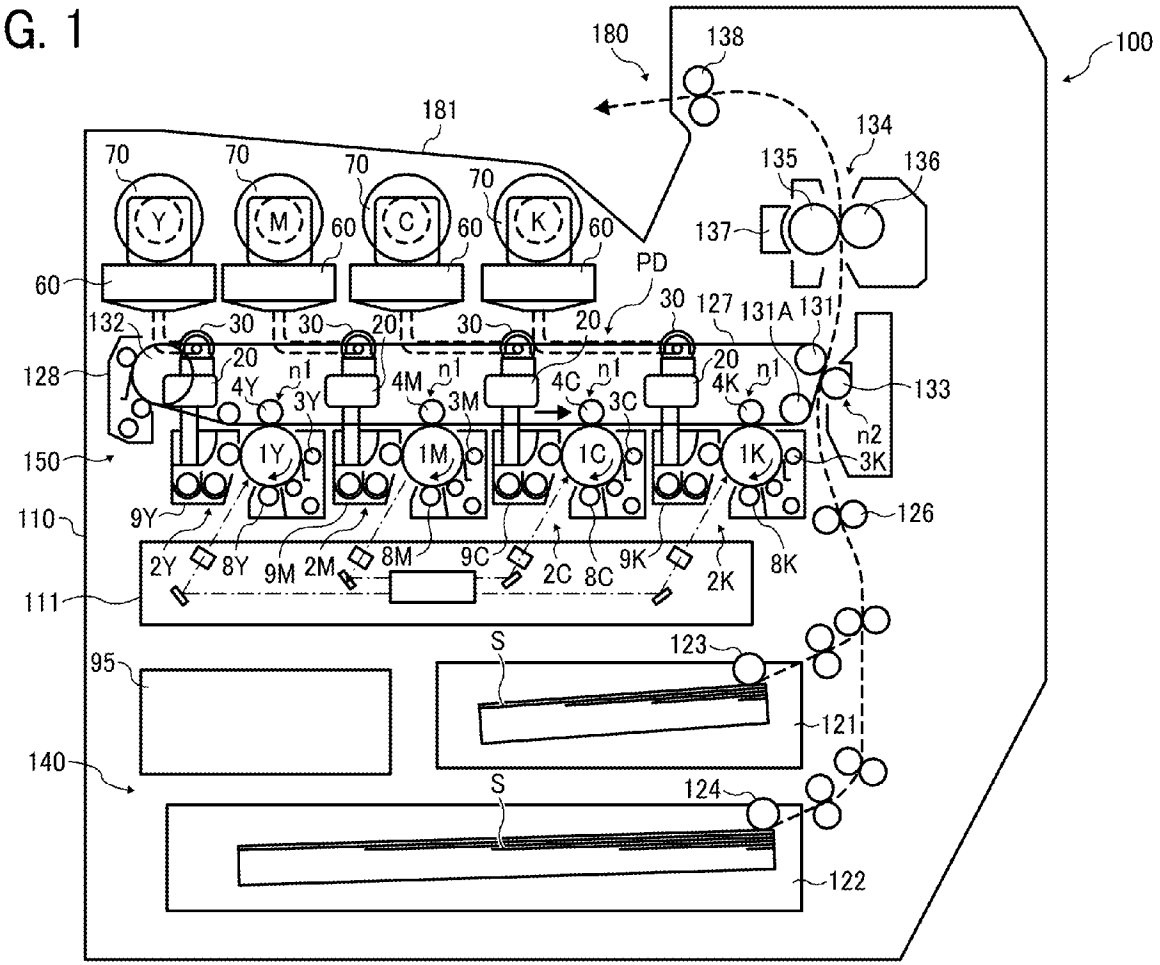
FIG. 1 is a schematic view of an image forming apparatus incorporating a developing device provided with a developer conveyance device according to an embodiment.

In describing preferred embodiments illustrated in the drawings, specific terminology is employed for the sake of clarity. However, the disclosure of this patent specification is not intended to be limited to the specific terminology so selected, and it is to be understood that each specific element includes all technical equivalents that operate in a similar manner and achieve a similar result.

Referring now to the drawings, wherein like reference numerals designate identical or corresponding parts throughout the several views thereof, and particularly to FIG. 1, a multicolor image forming apparatus incorporating a developing device provided with a developer conveyance device according to an embodiment of the present invention is described.

FIG. 1 is a schematic view of an image forming apparatus 100 according to the present embodiment. It is to be noted that reference numeral 95 in FIG. 1 represents a controller.

For example, the image forming apparatus 100 shown in FIG. 1 is a multicolor printer including multiple image forming units to form different color images, arranged along a stretched surface of a transfer belt of a primary-transfer section.

An apparatus body 110 of the image forming apparatus 100 includes a discharge section 180, an image forming assembly 150, and a sheet feeding unit 140.

The discharge section 180 is positioned in an upper portion of the apparatus body 110 and includes a pair of discharge rollers 138 to discharge sheets S on which images are formed and a discharge tray 181 on which the sheets S are stacked.

The image forming assembly 150 is positioned in a center portion of the apparatus body 110 and provided with image forming members and transfer members. These components are described later.

The sheet feeding unit 140 is positioned in a lower portion of the apparatus body 110 and includes sheet trays 121 and 122 for containing the sheets S as one example of recording media and a mechanism to feed the sheets S to the image forming assembly 150. The sheet trays 121 and 122 are arranged vertically. The sheets S are fed from the sheet trays 121 and 122 respectively by feed rollers 123 and 124 and then transported by conveyance rollers 126.

The image forming assembly 150 includes an intermediate transfer member such as an endless belt (hereinafter "intermediate transfer belt 127") and multiple image forming units 2Y, 2M, 2C, and 2K disposed along the stretched surface of the intermediate transfer belt 127. It is to be noted that letters Y, M, C, and K attached to the reference numeral representing the image forming units indicate the colors (yellow, magenta, cyan, and black) of toner used therein.

The image forming units 2Y, 2M, 2C, and 2K have a similar configuration except the color of toner used in image forming processes, and the image forming unit 2Y is described below as a representative.

The image forming unit 2Y includes a drum-shaped photoreceptor 1Y, serving as a latent image bearer, that is rotatable clockwise in FIG. 1.

Around the photoreceptor 1Y, the image forming members to perform the image forming processes are disposed. Specifically, a charging device 8Y, a developing device 9Y, a primary-transfer section n1 provided with primary-transfer rollers 4Y, and a cleaning device 3Y are disposed around the photoreceptor 1Y.

The intermediate transfer belt 127 is disposed above the image forming unit 2Y, looped around multiple rollers 131, 131A, and 132 and rotatable in the direction indicated by an arrow shown in the drawing. The stretched surface of the intermediate transfer belt 127 contacts the photoreceptor 1Y.

One side of the stretched surface of the intermediate transfer belt 127 serves as a secondary-transfer section n2. A secondary-transfer roller 133 is opposed to and in contact with the secondary-transfer section n2. Images are superimposed on the intermediate transfer belt 127 in primary transfer, and the secondary-transfer roller 133 transfers the images at a time onto the sheet S transported from the sheet feeding unit 140.

The photoreceptor 1Y is uniformly charged by the charging device 8Y while rotating, and a writing device 111 applies writing light thereto, thereby forming a latent image according to image data. Then, the electrostatic latent image is developed into a toner image with toner supplied from the developing device 9Y.

In the primary-transfer section n1, the toner image is transferred onto the intermediate transfer belt 127 upon application of a transfer bias from the primary-transfer roller 4Y. In the secondary-transfer section n2, the toner image is transferred onto the sheet S upon application of a transfer bias.

The above-described developing device 9Y can employ either one-component developer consisting essentially of toner or two-component developer including toner and carrier. In the present embodiment, two-component developer is used.

After the toner image is transferred in the primary-transfer section n1, the cleaning device 3Y removes toner remaining on the photoreceptor 1Y, and a discharger initializes a photosensitive layer of the photoreceptor 1Y as a preparation for subsequent image formation.

After the toner image is transferred at a time in the secondary-transfer section n2, a cleaning device 128 removes remaining toner, paper dust, or the like from the intermediate transfer belt 127.

Meanwhile, after the image is transferred thereto in the secondary-transfer section n2, the sheet S is forwarded to a fixing device 134, where the toner image is fixed thereon by a fixing roller 135 and a pressure roller 136. Subsequently, the sheet S is discharged via the discharge rollers 138 to the discharge tray 181.

In the fixing device 134 used in the present embodiment, the fixing roller 135 is heated by a heat source 137 employing an induction heating (IH) coil to rise a surface temperature thereof.

The image forming apparatus 100 shown in FIG. 1 can form both of single-color images (i.e., monochrome images) and multicolor images. In multicolor image formation, toner images transferred from the respective image forming units 2 are superimposed one on another on the intermediate transfer belt 127. By contrast, in single-color image formation, the image forming units 2 that are not used are disengaged from the intermediate transfer belt 127.

Next, descriptions are given below of a toner conveyance mechanism for the developing device in the present embodiment.

In the present embodiment, when a developer container containing developer enters a developer end state (or toner end state) as the developer is consumed, operating conditions to determine developer conveyance capability of a positive-displacement pump used for conveying developer (i.e., toner) using airflow are changed.

Specifically, when the developer container is deemed being in the developer end state, the developer conveyance capability of the positive-displacement pump is reduced from the capability with which developer is transported until then. Thus, the operating conditions are loosened, thereby inhibiting an inconvenience that a large amount of air is put in the developing device. The term "developer conveyance capability" used here means a volume that can be transported by a single pumping action of the positive-displacement pump.

Figure 2:
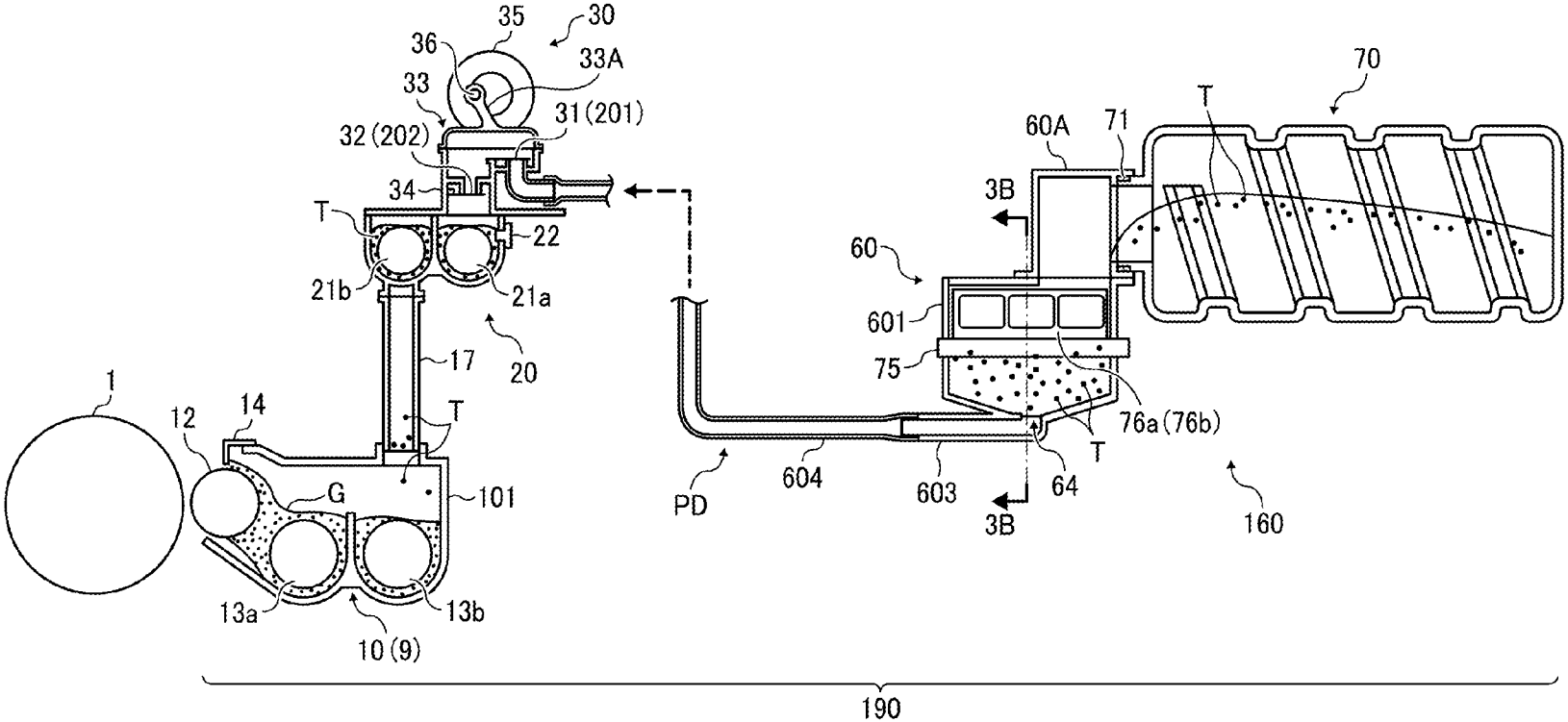
FIG. 2 is a cross-sectional view illustrating a configuration of the developer conveyance device used for the developing device shown in FIG. 1.

Referring to FIG. 2, descriptions are given below of a configuration of a developer conveyance channel including developing device 9.

In FIG. 2, the developer conveyance channel includes the developing device 9, an agitation section 20, a positive-displacement pump 30, a conveyance mechanism PD, and a replenishment device 160. The replenishment device 160 includes a replaceable developer container 70 to contain supplied toner and a toner reservoir 60 to temporarily store toner. In FIG. 2, reference letter "G" represents developer and "T" represents toner.

The developing device 9 is connected via the conveyance mechanism PD to the developer container 70, and the positive-displacement pump 30 and the agitation section 20 are disposed in midway through the conveyance mechanism PD. The respective components included in the conveyance channel together constitute a developer conveyance device 190.

The developing device 9 includes a developer chamber 101 inside which a developing sleeve 12 to generate a magnetic brush is disposed. Further, a supply screw 13*a* and an agitation screw 13*b* are disposed in compartments, partitioned from each other, inside the developer chamber 101. Additionally, a regulation blade 14 to regulate a layer thickness of developer is provided facing a circumferential face of the developing sleeve 12 upstream from a position where the developing sleeve 12 faces the photoreceptor 1.

Two-component developer is contained in the developer chamber 101 and transported while being agitated in an axial direction by the supply screw 13*a* and the agitation screw 13*b*.

The compartments inside which the supply screw 13*a* and the agitation screw 13*b* are respectively disposed communicate with each other at both ends in the axial direction of the supply screw 13*a* and the agitation screw 13*b*, and developer is circulated therebetween while being agitated.

Developer is scooped up onto the developing sleeve 12 by magnetic force exerted by a developer scooping pole positioned inside the developing sleeve 12. As the developing sleeve 12 rotates, the developer thereon moves. After the layer thickness thereof is regulated by the regulation blade 14, the developer is used to develop the electrostatic latent image on the photoreceptor 1.

After used in image development, the developer is separated from the developing sleeve 12 by a repulsive magnetic pole positioned inside the developing sleeve 12 and collected by the agitation screw 13*b*. The collected developer is then agitated.

The agitation section 20 serves as a reservoir capable of sending out toner introduced from the developer container 70 when the density of toner in the developing device 9 decreases.

The agitation section 20 is provided with a tank including partitioned compartments. The toner introduced from the developer container 70 enters one of the compartments and is sent out from the other compartment to the developing device 9.

Screws 21*a* and 21*b* are disposed in the respective compartments to agitate, for frictional charging, the toner temporarily stored therein similarly to the supply screw 13*a* and the agitation screw 13*b* inside the developing device 9. The toner temporarily stored in the agitation section 20 can be circulated inside the tank since the compartments thereof communicate with each other at both ends in the axial direction of the screws 21*a* and 21*b*.

The compartment provided with the screw 21*b* is connected via a pipe 17 to the compartment provided with the agitation screw 13*b* inside the developer chamber 101 of the developing device 9.

The tank of the agitation section 20 is provided with a developer amount detector 22. In the present embodiment, for example, the developer amount detector 22 can be a piezoelectric sensor to detect the amount of toner stored in the tank with the bulk or level of toner. The developer amount detector 22 is connected to the controller 95 (shown in FIG. 1) and used in drive control of the positive-displacement pump 30 executed by the controller 95. That is, this detector is used for driving the positive-displacement pump 30 to introduce supplied toner thereto when the amount of toner stored in the agitation section 20 falls to or below a predetermined amount.

The positive-displacement pump 30 is united to the agitation section 20 as a single unit. The positive-displacement pump 30 is for sending out toner toward the developing device 9 according to changes in volume per a constant driving cycle.

The positive-displacement pump 30 is constructed of a suction valve 31, a discharge valve 32, and a pump case 34 defining a space in which a diaphragm 33 is provided. The suction valve 31 is used to open and close a suction inlet 201 for the toner introduced from the developer container 70. The discharge valve 32 is used to open and close a toner outlet 202 through which toner is discharged to the compartment provided with the screw 21*a*.

The diaphragm 33 is constructed of a material having a shape restoration capability and can sag and deform. The diaphragm 33 reduces the volume inside the pump case 34 when pressed. When the diaphragm 33 is released, its original shape is restored, and the volume inside the pump case 34 is increased from the reduced volume. In the configuration shown in FIG. 2, the suction valve 31 closes the suction inlet 201 when the diaphragm 33 is pressed and the interior of the pump case 34 is set at positive pressure. The discharge valve 32 closes the toner outlet 202 when the diaphragm 33 is released from the pressing and the interior of the pump case 34 is set at negative pressure.

Accordingly, when the interior of the pump case 34 is set at positive pressure, the suction valve 31 closes, and the discharge valve 32 opens. When the interior of the pump case 34 is set at negative pressure, the suction valve 31 opens, and the discharge valve 32 closes. With this configuration, in the agitation section 20, as positive pressure and negative pressure are generated alternately, the suction valve 31 and the discharge valve 32 are opened and closed alternately, and inflow of toner from the developer container 70 and discharge of toner alternate.

The present embodiment is hereinafter described assuming that the diaphragm pump is used in the positive-displacement pump 30.

The diaphragm 33 to vary the pressure inside the diaphragm 33 is pressed and released using a diaphragm motor M3 (shown in FIG. 4), serving as a driving source, and a support rod 36 disposed at an eccentric position of a rotatable plate 35 driven by the diaphragm motor M3.

A driving piece 33A extending from the diaphragm 33 is connected to the support rod 36. The driving piece 33A presses and releases the diaphragm 33 according to changes in rotational phase of the support rod 36 rotating eccentrically.

By contrast, the developer container 70 shown in FIG. 2 is a cylindrical bottle, and a spiral groove is provided therein.

With this structure, as the developer container 70 rotates, the toner therein moves from the right to the left in FIG. 2 in a lead direction of the spiral groove and flows out from a bottle opening.

In FIG. 2, a seal member 71 is provided at an end of the developer container 70. The seal member 71 is constructed of an elastic body such as sponge, fitted to the toner reservoir 60 via a holder 60A, and slidingly rotatable together with the developer container 70.

To the developer container 70, the toner reservoir 60 is connected. The toner reservoir 60 can temporarily store the toner sent from the developer container 70 and supply a constant amount of toner to the agitation section 20 connected to the developing device 9.

When the developer container 70 is disposed sideways, toner is sent out therefrom in a direction other than the direction of gravity. The toner reservoir 60 serves as a buffer to inhibit fluctuations in the amount of toner sent out at that time and maintain a stable amount of toner transported to the agitation section 20.

Figure 3A:
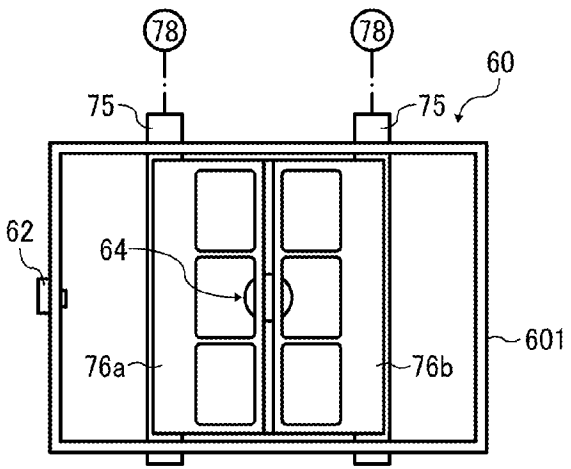
FIGS. 3A, 3B, and 3C are views of a toner reservoir used in the developer conveyance device along a direction indicated by arrow 3B shown in FIG. 2.
Figure 3B:
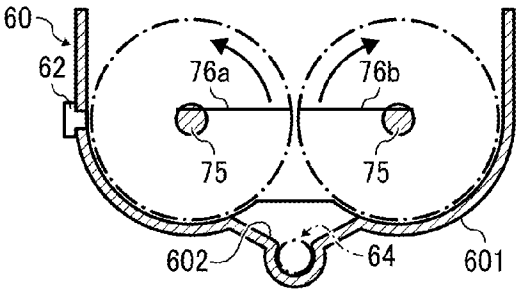
Figure 3C:
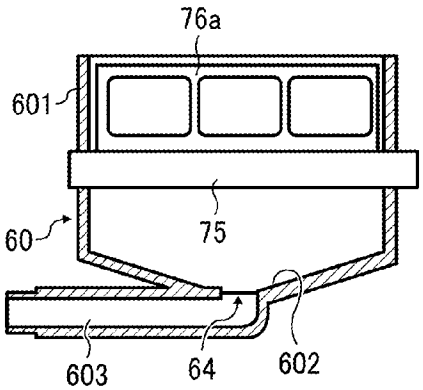

A bottom side of the toner reservoir 60 is inclined toward a center position and includes an annular tapered face 602 (shown in FIGS. 3B and 3C). In a deepest portion of the toner reservoir 60, an outlet 64 communicating with a lateral discharge channel 603 is provided.

A pipe 604 used in the conveyance mechanism PD is connected between the lateral discharge channel 603 and the suction inlet 201 of the agitation section 20.

In FIGS. 2 through 3C, inside a casing 601 of the toner reservoir 60, two paddle shafts 75 are disposed with their axes parallel to the longitudinal direction of the developer container 70. The paddle shafts 75 are away from each other across a center portion as shown in FIGS. 3A and 3B.

Planer paddles 76*a* and 76*b* are respectively provided to the paddle shafts 75, with base ends thereof attached to the paddle shafts 75.

For example, the paddle shafts 75 are rods constructed of resin or metal, and the paddles 76*a* and 76*b* are constructed of resin or thin metal plates. The paddles 76*a* and 76*b* are united to the paddle shafts 75 and designed to move together.

As shown in FIG. 3B, the paddles 76*a* and 76*b* are configured to rotate in an identical direction when facing to each other in the center portion of the casing 601. As the paddle shafts 75 are driven by paddle motors 78 (shown in FIG. 3A), the paddles 76*a* and 76*b* are thus rotated.

Since the bottom face of the casing 601 is tapered (i.e., the tapered face 602) and the outlet 64 is provided in the deepest portion thereof, each of the paddles 76*a* and 76*b* rotates from an inner wall side of the casing 601 to a deeper side thereof. This configuration can facilitate movement of toner toward the outlet 64.

A developer detector 62 to detect the amount of toner is provided to the casing 601. The developer detector 62 can be piezoelectric type, for example.

The developer detector 62 detects the position of a toner powder surface (i.e., surface level) to monitor the amount of toner contained in the toner reservoir 60 and used to judge whether toner remains therein according to reference data preliminarily stored in the controller 95. When signals from the developer detector 62 indicate continuously for a certain period that the level of toner is lower than a reference position, the controller 95 deems the developer container 70 being in a toner end state (developer end state) described later.

In the present embodiment, the developer amount detector 22 provided to the agitation section 20 and the developer detector 62 provided to the toner reservoir 60 are piezoelectric-type level sensors. Accordingly, these detectors output signals indicating decreases in toner surface level to the controller 95 when the toner power surfaces in the tank of the agitation section 20 and the casing 601 of the toner reservoir 60 fall below sensor faces thereof, respectively.

Figure 4:
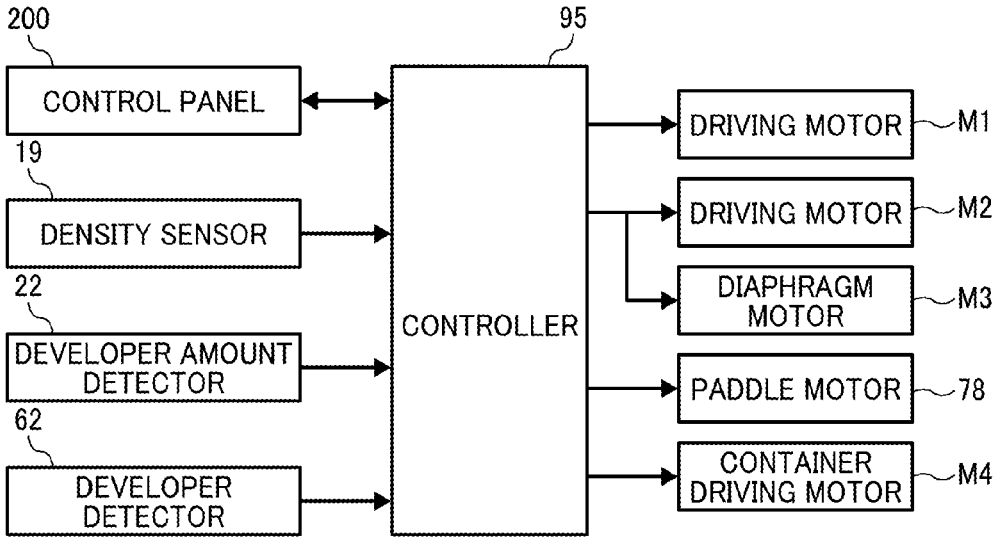
FIG. 4 is a block diagram illustrating a configuration of a controller used for the developing device shown in FIGS. 2.

FIG. 4 is a block diagram illustrating a configuration of the controller 95 to execute the above-described operation.

In the configuration shown in FIG. 4, a sequence program to execute image formation is stored in the controller 95, and a control panel 200, the developer amount detector 22, and the developer detector 62 are connected to an input side of the controller 95 as elements relating to the present embodiment.

To an output side of the controller 95, driving sources for the developing device 9, the agitation section 20, the toner reservoir 60, and the developer container 70 are connected.

The driving source used for the developing device 9 includes a driving motor M1 to drive the developing sleeve 12, the supply screw 13*a*, and the agitation screw 13*b*.

The driving source used for the agitation section 20 includes a driving motor M2 to drive the screws 21*a* and 21*b* and the diaphragm motor M3 to drive the diaphragm 33.

The paddle motors 78 to drive the paddles 76*a* and 7*bb* serves as the driving source used for the toner reservoir 60.

The driving source used for the developer container 70 includes a container driving motor M4 to drive a gear that meshes with a gear portion on an outer circumferential face of the developer container 70. It is to be noted that, although only the configuration relating to the present embodiment is illustrated in FIG. 4, the image forming apparatus 100 includes other driving sources, such as motors to drive the photoreceptors 1 and the rollers to rotate the intermediate transfer belt 127, a motor to drive the components used for sheet conveyance, and a motor to rotate the fixing roller 135 and the pressure roller 136 of the fixing device 134.

When a density sensor 19 (shown in FIG. 4) provided to the developing device 9 detects that the density of toner in the developing device 9 falls during image formation, the controller 95 drives the screws 21*a* and 21*b* of the agitation section 20, thereby supplying toner to the developing device 9.

By contrast, when the controller 95 judges, according to the signal from the developer amount detector 22, that the amount of toner stored in the agitation section 20 is small, the controller 95 drives the diaphragm motor M3, thereby introducing toner from the toner reservoir 60.

When the controller 95 judges, according to the signal from the developer detector 62, that the amount of toner stored in the toner reservoir 60 is small, the controller 95 drives the container driving motor M4, thereby discharging toner from the developer container 70 toward the toner reservoir 60.

The diaphragm motor M3 and the container driving motor M4 are driven consecutively until it is judged that the toner power surface reaches the reference position according to the signal from the developer amount detector 22 or the developer detector 62. With this operation, the amount of toner stored in the agitation section 20 and the toner reservoir 60 can be kept constant or substantially constant while developer (toner in the present embodiment) can be sent out from the developer container 70 according to commands from the controller 95.

Additionally, in the present embodiment, the paddles 76*a* and 76*b* of the toner reservoir 60 are rotated for one second (1 sec) prior to driving of the positive-displacement pump 30 (i.e., diaphragm pump).

This is advantageous as follows. When a large amount of toner is stored in the toner reservoir 60 to inhibit shortage of toner to be transported to the agitation section 20, toner can become a state of bridges due to compression and coagulation among toner particles. This operation can loosen the toner and help toner to flow to the outlet 64.

The paddles 76*a* and 76*b* are thus rotated in advance in accordance with operating timing of the positive-displacement pump 30 and stopped as the diaphragm pump stops.

The respective driving sources are thus controlled during image formation.

The controller 95 uses, as a toner ejection condition of the positive-displacement pump 30, a setting to attain a maximum flow amount of 5 liters per minute (L/min) by rotating the diaphragm motor M3 at a velocity of about 2500 revolutions per minute (rpm).

Accordingly, the positive-displacement pump 30 is configured to operate for 0.6 second in a single pumping action. Thus, with a single pumping action, a volume of 50 cc (5000/60×0.6) can be sucked in or discharged at a maximum.

In accordance with consumption in the developing device 9, the amount of toner contained in the developer container 70 gradually decreases to a degree that no toner flows out therefrom.

Then, no toner is supplied to the toner reservoir 60. In this state, if the positive-displacement pump 30 is driven under the above-described condition, the mount of toner in the toner reservoir 60 decreases, and the amount of air discharged therefrom increases.

When the ratio of air is greater in the blend ratio of toner and air, the amount of air transported to the developing device 9 is greater than the amount of toner, and the internal pressure of the developing device 9 increases, resulting in scatter of toner.

Therefore, as toner is consumed, when the developer container 70 reaches the state of "toner end" (i.e., developer end state), in which no toner (i.e., no developer) is discharged therefrom, the controller 95 reduces the developer conveyance capability from the setting used until then.

To reduce the developer conveyance capability of the positive-displacement pump 30, the rotational frequency or operating time of the diaphragm motor M3, which is the driving source for the positive-displacement pump 30, is changed.

Specifically, one of the operating conditions to set the developer conveyance capability, the rotational frequency of the diaphragm motor M3, is switched to a setting lower than the setting used before the toner end state is recognized with the developer detector 62 and a counter.

Alternatively, the operating time of the diaphragm motor M3 is switched to a setting shorter than that used before toner end state is recognized with the developer detector 62 and the counter.

When the rotational frequency of the diaphragm motor M3 is switched to the lower setting, the volume of air transportable by a single pumping action of the diaphragm pump is reduced. Accordingly, the amount of air transported can be reduced.

Similarly, when the operating time of the diaphragm motor M3 is switched to the shorter setting, the volume of air transportable by the diaphragm pump is reduced. Accordingly, the amount of air transported can be reduced.

As a result, increases in the amount of air introduced into the agitation section 20, the developing device 9, or both, which are downstream from the positive-displacement pump 30 in the direction in which toner is conveyed in the developer conveyance device 190, can be limited, and internal pressure rise of the downstream sections can be inhibited, thus inhibiting scattering of toner.

For example, when the rotational frequency of the diaphragm motor M3 is set at 2500 rpm during standard image formation (or before the recognition of toner end state), to reduce the developer conveyance capability, the rotational frequency can be switched to 2000 rpm by lowering voltage supplied to the diaphragm motor M3. In the case of operating time, when the operating time of the diaphragm motor M3 is set at 0.6 ms during standard image formation (or before the recognition of toner end state), the operating time can be switched to 0.4 ms by changing application time of voltage to the diaphragm motor M3.

To judge whether the developer container 70 is in the toner end state, the controller 95 that executes the above-described control operation rotates the developer container 70 for a predetermined period consecutively from when the developer detector 62 detects decreases in the toner power surface in the toner reservoir 60.

When toner increases and the surface level thereof increases after the developer container 70 is rotated for the predetermined period, the rotation of the developer container 70 is stopped. By contrast, when the surface level of toner does not increase, the controller 95 deems the developer container 70 being in the toner end state (i.e., developer end state).

Recognizing the toner end state of the developer container 70, the controller 95 stops to rotate the developer container 70, and simultaneously alerts users or operators to replacement of the developer container 70 on the control panel 200.

By contrast, when the controller 95 judges that the developer container 70 should be replaced, image formation is continued using the remaining toner on the assumption that toner remains in the agitation section 20 and the toner reservoir 60. That is, supply of toner to the developing device 9 is continued.

In this case, in accordance with consumption of toner in the developing device 9, conveyance of toner to the developing device 9 is continued in the state in which the developer conveyance capability by the diaphragm motor M3, which is the driving source of the positive-displacement pump 30, is reduced from the setting used before the developer container 70 is deemed to be in the toner end state. Specifically, driving of the developing device 9 is continued as long as toner is supplied from the agitation section 20 and the toner reservoir 60 to the developing device 9.

When insufficiency of the density of toner in the developing device 9 is not resolved for a predetermined period according to the density sensor 19, it is judged that no remains in the agitation section 20 or the toner reservoir 60.

Figure 5A:
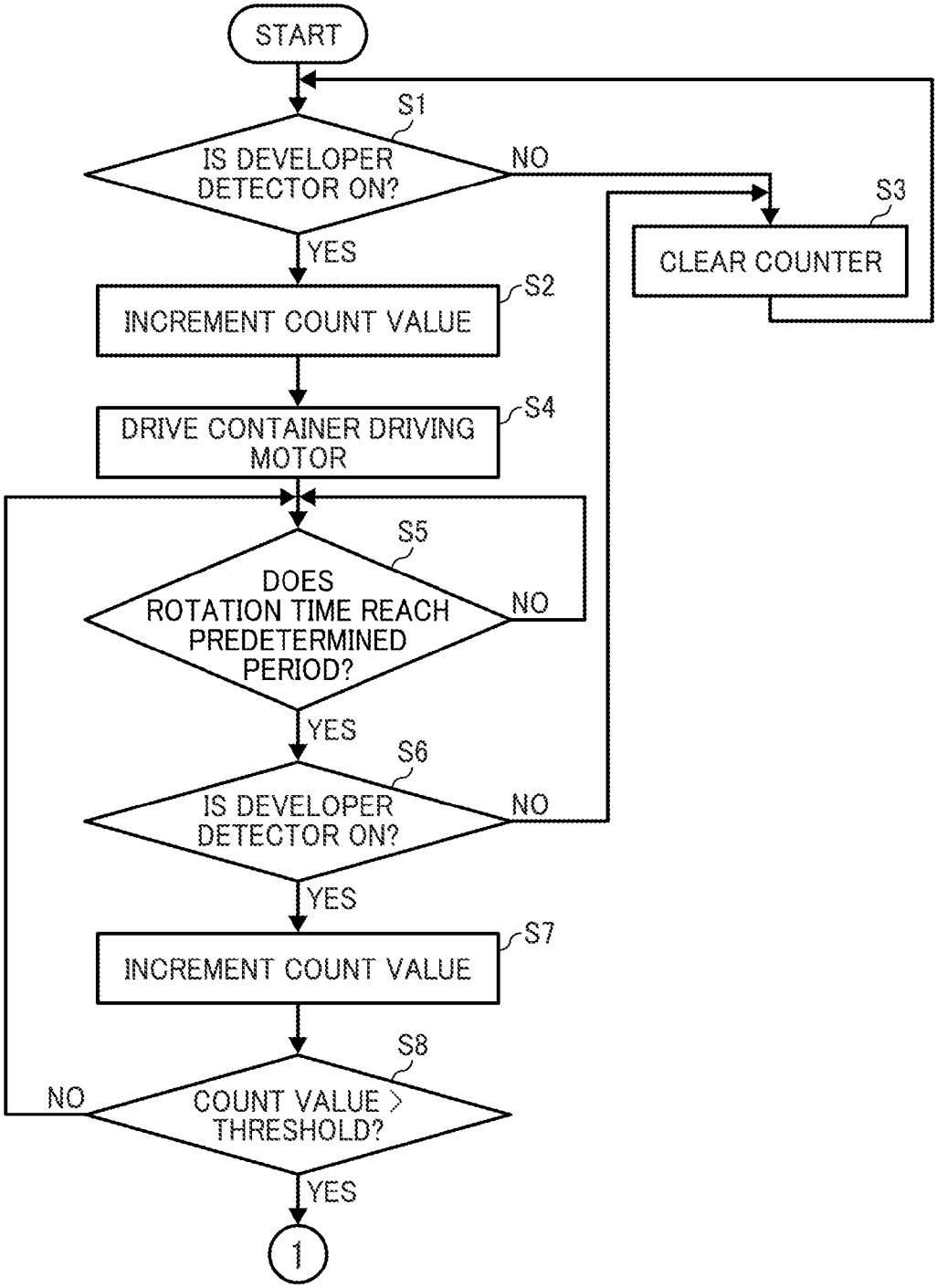
FIGS. 5A and 5B are flowcharts of control operation of the controller shown in FIG. 4.
Figure 5B:
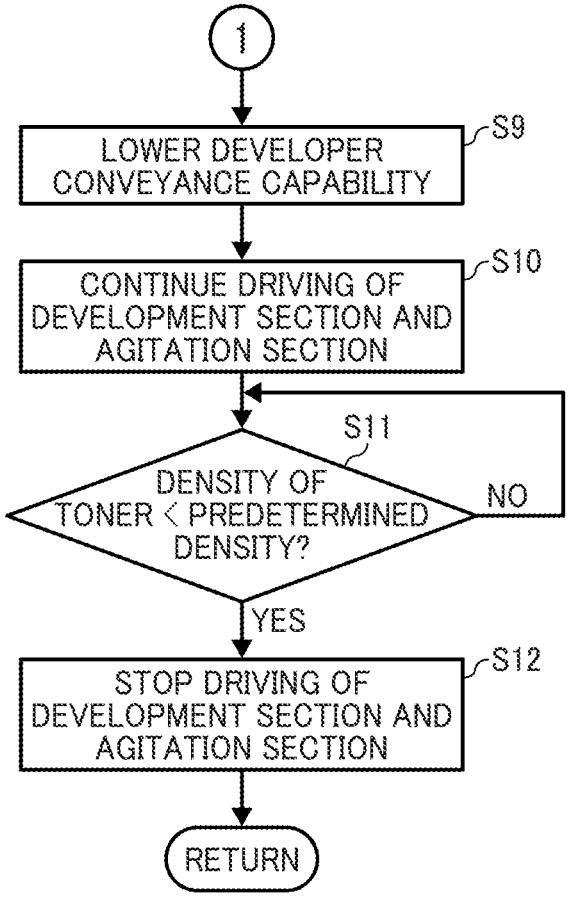

Descriptions are given below of a developer conveyance method, controlled by the controller 95 according to the present embodiment with reference to a flowchart shown in FIGS. 5A and 5B.

The signal output from the developer detector 62 is used to judge whether or not toner remains in the developer container 70. At S1, the controller 95 checks whether the developer detector 62 is on, that is, whether the signal is output from the developer detector 62.

According to a state of signal output, it is judged whether the toner power surface inside the toner reservoir 60 is at or below the reference position. When the signal indicating that the toner surface level is at or below the reference position is output, at S2, the number of times of detection is incremented with the counter. By contrast, when that signal is not output, at S3, the counter is cleared.

When the signal is output from the developer detector 62, at S4, the container driving motor M4 is driven for the predetermined period. With this operation, toner can be discharged from the developer container 70.

At S5, whether or not the period of rotation of the developer container 70 reaches the predetermined period is judged. At the timing when the period of rotation reaches the predetermined period, at S6 the presence of signal from the developer detector 62 is judged. The process at S6 is similar to that at S1, and it is checked whether toner flows out therefrom after the developer container 70 is rotated.

In the case in which the signal is output from the developer detector 62 even after the rotation of the developer container 70, at S7, the counter is incremented again. At S8, a count value at that time is compared with a threshold for recognizing the toner end state of the developer container 70.

The count value in this case includes the count value at S2 and is an accumulative value representing a time period during which toner does not flow out. As this accumulative value increases, the toner end state of the developer container 70 is recognized.

In other words, when the developer container 70 is rotated for the predetermined period in response to the decrease in toner power surface detected by the developer detector 62, the period of the rotation until the developer detector 62 detects the toner power surface is counted.

The period until the developer detector 62 detects the toner power surface differs depending on whether toner flows out from the developer container 70, thus increasing the toner power surface, when the developer container 70 rotates. Therefore, when the period until the developer detector 62 detects the toner power surface reaches or exceeds the threshold, it means that no toner is flowing from the developer container 70. In other words, the developer container 70 is in the toner end state.

Accordingly, when the threshold is set at a count value corresponding to the toner end state of the developer container 70, it can be determined that the developer container 70 is in the toner end state using the counter value equal to or greater than the threshold.

When the toner end state of the developer container 70 is recognized based on the result of comparison at S8, at S9, the developer conveyance capability is switched to the setting lower than that during image formation.

With this operation, the volume of air transportable by the action of the diaphragm pump is reduced. Accordingly, the amount of air transported can be reduced.

Meanwhile, after the developer conveyance capability is lowered, the supplied toner still remains in the developing device 9 and the agitation section 20 and used in image formation. Specifically, at S10, the driving motors M1 and M2 and the diaphragm motor M3 for the developing device 9 and the agitation section 20 are kept driving to continue image formation, and, at S11, it is judged whether a detection result generated by the density sensor 19 indicate that the density of toner included in developer in the developing device 9 falls to or below the predetermined density. When the judgment at S11 is "Yes", at S12, these motors are stopped. That is, the driving sources for the developing device 9 and the agitation section 20 are kept driving until the fall in density of toner is thus detected.

It is to be noted that, any one of the above-described and other example features of the present invention may be embodied in the form of an apparatus, method, system, computer program and computer program product. For example, the aforementioned developer conveyance method may be embodied in the form of a system or device, including, but not limited to, any of the structure for performing the methodology illustrated in the drawings.

Even further, any aspects of the aforementioned method may be embodied in the form of a program. The program may be stored on a computer readable media and is adapted to perform any one of the aforementioned methods when run on a computer device (a device including a processor). Thus, the storage medium or computer readable medium, is adapted to store information and is adapted to interact with a data processing facility or computer device to perform the method of any of the above mentioned embodiments.

As described above, according to the embodiment described above, when the toner supplied from the developer container 70 runs short, inflow of a large amount of air into the developing device 9 can be inhibited by simply changing the developer conveyance capability. Accordingly, using an existing configuration, inconveniences such as scattering of toner from the developing device 9, the agitation section 10, or both can be inhibited.

Additionally, changing the developer conveyance capability as described above is advantageous, compared with a case in which the conveyance capability is kept constant, in a state in which the amount of toner is small with respect to the amount of air in conveyance of toner using pressure changes caused by the positive-displacement pump. In this state, since the amount of force required for conveying toner is alleviated, the flow rate of air increases, and the amount of toner introduced into the section downstream from the pump in the direction in which toner is conveyed in the developer conveyance device 190, namely, the developing device 9, the agitation section 20, or both, increases. At that time, changing the developer conveyance capability can inhibit a risk that the density of toner in the downstream section increases excessively.

Thus, according to an aspect of the present specification, in conveyance of developer, such as toner, using pressure changes caused by the positive-displacement pump 30, the amount of toner supplied can be kept substantially constant even when the amount of toner introduced into the developing device 9 by air conveyance decreases and the amount of air increases.

Yet additionally, according to another aspect of the present specification, even when the developer container 70 is disposed sideways and toner flows out therefrom in a direction different from the direction of gravity, the toner reservoir 60 serving as a buffer to temporarily store toner can stabilize the amount of toner transported using pressure changes of the positive-displacement pump 30.

Yet additionally, according to another aspect of the present specification, when the developer container 70 is deemed being in the state of toner end or developer end, image formation can be continued using the toner remaining in the agitation section 20 and the toner reservoir 60 when the developer conveyance capability is lowered from the setting for standard image formation. This configuration is advantageous in using toner efficiently and reducing running cost over a configuration in which image formation is stopped simultaneously with switching of the developer conveyance capability.

Numerous additional modifications and variations are possible in light of the above teachings. It is therefore to be understood that, within the scope of the appended claims, the disclosure of this patent specification may be practiced otherwise than as specifically described herein.

What is claimed is:

1. An image forming apparatus comprising:

a developing device;

a developer conveyance device configured to convey developer to the developing device, the developer conveyance device including, a developer container, a developer reservoir configured to receive developer discharged from the developer container, a positive-displacement pump configured to discharge, from the developer reservoir, developer supplied to the developing device by alternately generating positive pressure and negative pressure due to volume changes, and a developer amount detector configured to detect an amount of developer in the developer reservoir; and a controller configured to control driving of the positive-displacement pump, wherein, when the controller recognizes a developer end state of the developer container, the controller is configured to lower a developer conveyance capability of the positive-displacement pump from a setting used before the developer end state is recognized, the controller is configured to control driving of the positive-displacement pump according to a signal from the developer amount detector, the controller is configured to drive the developer container for a set period when the signal from the developer amount detector indicates that the amount of developer in the developer reservoir is not greater than a set amount, and the controller is configured to recognize the developer end state of the developer container when the amount of developer in the developer reservoir is not increased by driving the developer container for the set period.

2. The image forming apparatus according to claim 1, wherein, when the developer conveyance capability of the positive-displacement pump is lowered, the controller is configured to drive the developing device until the controller determines that no developer remains in a developer conveyance channel from the developer reservoir to the developing device.

3. The image forming apparatus according to claim 2, wherein the developing device comprises:

a density sensor configured to detect a density of developer in the developing device, and when a detection result generated by the density sensor indicates that the density of developer in the developing device falls to or below a set density, the controller is configured to determine that no developer remains in the developer conveyance channel from the developer reservoir to the developing device.

4. The image forming apparatus according to claim 1, further comprising:

a driving source configured to drive the positive-displacement pump, wherein the developer conveyance capability is lowered by reducing a rotational frequency of the driving source.

5. The image forming apparatus according to claim 1, further comprising:

a driving source configured to drive the positive-displacement pump, wherein the developer conveyance capability is lowered by reducing a duration of operation of the driving source.

6. A developer conveyance device comprising:

a developer container;

a developer reservoir configured to receive developer discharged from the developer container;

a positive-displacement pump configured to discharge, from the developer reservoir, developer supplied to a developing device by alternately generating positive pressure and negative pressure due to volume changes;

a developer amount detector configured to detect an amount of developer in the developer reservoir, wherein, when a developer end state of the developer container is recognized, a developer conveyance capability of the positive-displacement pump is lowered by a controller from a setting used before the developer end state of the developer container is recognized, the controller is configured to control driving of the positive-displacement pump according to a signal from the developer amount detector, the controller is configured to drive the developer container for a set period when the signal from the developer amount detector indicates that the amount of developer in the developer reservoir is not greater than a set amount, and the controller is configured to recognize the developer end state of the developer container when the amount of developer in the developer reservoir is not increased by driving the developer container for the set period.

7. A developer conveyance method comprising:

temporarily storing developer discharged from a developer container;

discharging, with a positive-displacement pump, the developer temporarily stored by alternately generating positive pressure and negative pressure due to volume changes;

judging whether or not the developer container is in a developer end state;

lowering a developer conveyance capability of the positive-displacement pump, from a setting used before the developer end state is recognized, when the developer container is judged to be in the developer end state;

detecting an amount of the developer temporarily stored;

driving the developer container for a set period after a result of the detecting indicates that the amount of the developer temporarily stored is not greater than a set amount;

recognizing that the developer container is in the developer end state when the amount of the developer temporarily stored is not increased by the driving.

8. The developer conveyance method according to claim 7, further comprising:

keeping a developing device driving when the developer conveyance capability of the positive-displacement pump is lowered;

detecting a density of the developer in the developing device;

determining that none of the developer remains in a developer conveyance channel to the developing device when it is detected that the density of the developer in the developing device falls to or below a set density; and stopping the developing device.

9. A controller configured to control a developer conveyance device, the developer conveyance device including a developer reservoir and a positive displacement pump configured to discharge developer received from a developer container, the controller comprising:

a memory and a processor, the memory containing computer readable code that, when executed by the processor, configures the processor to:

recognize a developer end state of the developer container, control driving of the positive-displacement pump according to a signal from a developer amount detector, the signal indicating an amount of developer in the developer reservoir, and drive the developer container for a given period after a result of detecting the signal from the developer amount detector indicates that the amount of developer temporarily stored in the developer reservoir is not greater than a given amount.

* * * * *